US009970243B2

(12) United States Patent
Still et al.

(10) Patent No.: US 9,970,243 B2
(45) Date of Patent: May 15, 2018

(54) SNUBBING UNIT FOR INSERTING TUBULAR MEMBERS WITHOUT A RISER

(71) Applicant: BLUE OCEAN TECHNOLOGIES LLC, Conroe, TX (US)

(72) Inventors: Ian R. Still, Bellaire, TX (US); Neil Crawford, The Woodlands, TX (US); Brandon Harman, Spring, TX (US); John R. Cook, Kingwood, TX (US); Robert L. Ewen, Houston, TX (US)

(73) Assignee: OCEANEERING INTERNATIONAL, INC., Houston, TX (US)

( * ) Notice: Subject to any disclaimer, the term of this patent is extended or adjusted under 35 U.S.C. 154(b) by 0 days. days.

(21) Appl. No.: 15/222,437

(22) Filed: Jul. 28, 2016

(65) Prior Publication Data

US 2018/0030790 A1 Feb. 1, 2018

(51) Int. Cl.

| | |
|---|---|
| ***E21B 19/00*** | (2006.01) |
| ***E21B 19/24*** | (2006.01) |
| ***E21B 19/10*** | (2006.01) |

(52) U.S. Cl.

CPC ..... *E21B 19/002* (2013.01); *E21B 19/10* (2013.01); *E21B 19/24* (2013.01)

(58) Field of Classification Search

CPC ..... E21B 19/18; E21B 19/10; E21B 19/24; E21B 19/002

See application file for complete search history.

(56) References Cited

U.S. PATENT DOCUMENTS

| | | | | |
|---|---|---|---|---|
| 5,094,340 | A * | 3/1992 | Avakov | B65G 37/005 198/604 |
| 5,309,990 | A | 5/1994 | Lance | |
| 5,988,274 | A | 11/1999 | Funk | |
| 6,116,345 | A | 9/2000 | Fontana et al. | |
| 6,158,516 | A | 12/2000 | Smith et al. | |
| 6,688,393 | B2 * | 2/2004 | Sredensek | E21B 19/02 166/377 |
| 6,854,520 | B1 | 2/2005 | Robichaux | |
| 7,438,505 | B2 | 10/2008 | Olsen | |
| 7,819,183 | B2 * | 10/2010 | Borgstadt | B25J 9/1664 166/250.01 |
| 8,376,041 | B2 * | 2/2013 | Shampine | E21B 33/068 166/77.1 |
| 8,720,582 | B2 | 5/2014 | Portman | |
| 8,939,219 | B2 * | 1/2015 | Taskinen | E21B 44/00 166/255.1 |
| 9,151,123 | B2 | 10/2015 | Portman | |

(Continued)

*Primary Examiner* — Matthew R Buck
*Assistant Examiner* — Douglas S Wood
(74) *Attorney, Agent, or Firm* — Maze IP Law, PC

(57) ABSTRACT

The snubbing unit inserts a tubular member into a well without a riser. The snubbing unit includes a set of stationary slips in a first base plate, a first set of traveling slips in a second base plate, a second set of traveling slips in a third base plate, and a plurality of hydraulic cylinders connecting the base plates. Each set of slips has an engaged position and a released position relative to the hydraulic cylinders. The base plates are cooperative with a pipe guide so that movement of the tubular member between the base plates corresponds to consistent support of the tubular member to preventing buckling. The snubbing unit increases safety and support for inserting into the well without a riser.

20 Claims, 3 Drawing Sheets

(56) References Cited

U.S. PATENT DOCUMENTS

| | | | | |
|---|---|---|---|---|
| 9,422,784 | B2 * | 8/2016 | Shah | E21B 19/00 |
| 2003/0178200 | A1 | 9/2003 | Fox et al. | |
| 2006/0078390 | A1 | 4/2006 | Olsen et al. | |
| 2007/0084606 | A1 | 4/2007 | Ponville | |
| 2011/0284234 | A1 | 11/2011 | Portman | |
| 2012/0006565 | A1 | 1/2012 | McKinnon et al. | |
| 2016/0245026 | A1 * | 8/2016 | Newman | E21B 19/24 |

* cited by examiner

SNUBBING UNIT FOR INSERTING TUBULAR MEMBERS WITHOUT A RISER

CROSS-REFERENCE TO RELATED APPLICATIONS

See Application Data Sheet

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a snubbing unit for inserting tubular members at a subsea well under pressure. More particularly, the present invention relates to a subsea assembly without a riser to insert tubular members with a snubbing unit. Even more particularly, the present invention relates to an assembly with a snubbing unit and pipe guide to prevent buckling of the tubular member during a snubbing operation.

2. Description of Related Art Including Information Disclosed Under 37 CFR 1.97 and 37 CFR 1.98

Oil and gas fields on the ocean floor require subsea production systems for exploring, drilling, and producing under extreme environmental conditions. Subsea production systems are specialized equipment to develop these remote oil and gas fields, while being economically cost-effective and safe guarding the environment. Subsea wells present difficult problems because the wellbore is located thousands of feet from the ocean surface. The ability to erect a rig and overhead support is severely limited and expensive. The locations are remote; the equipment itself is difficult to transport and to deploy; the delivery of building and maintenance resources spans large underwater distances; and the expense of intervention can risk economic failure of an entire subsea production system.

A snubbing unit is a type of specialized equipment for oil production and well intervention. The snubbing unit or "hydraulic workover unit" or "snubbing jack" pushes pipe into a well against pressure. Subsea snubbing is a heavy duty well intervention with more conventional drill pipe, instead of wireline or coiled tubing, which is more typical subsea materials. The subsea location of the well requires the snubbing unit to be further specialized for withstanding the underwater conditions and providing the force and pressure necessary to push pipe or snub into the well.

Various patents and publications disclose technology related to snubbing units and accessory devices for snubbing units.

U.S. Pat. No. 6,116,345, issued to Fontana et al on Sep. 12, 2000, discloses a prior art tubing injection system for land and underwater wells. A first injector at the wellbore on land or on the ocean floor pushes pipe or coiled tubing into the well. A second injector transfers the pipe or coiled tubing from a storage location to the first injector.

U.S. Pat. No. 6,854,520, issued to Robichaux on Feb. 15, 2005, describes a baseline prior art apparatus and method for handling a tubular. The apparatus attaches two sets of slips to a tubular member, and one set of slips can move closer or farther from the other set of slips. The snubbing unit can be surface or subsea.

United States Patent Publication No. 20070084606, published for Ponville on Apr. 19, 2007, teaches a rig assist compensation system. The snubbing jack has a base frame to compensate for heave, when the snubbing jack is on a rig. Vertical movement of the rig is balanced by base frame so that the snubbing is not disrupted. The base frame provides stability to the snubbing unit.

United States Patent Publication No. 20060078390, published for Olsen et al on Apr. 13, 2006, teaches another heave compensated snubbing system. A piston connects to the traveling slip of the snubbing unit. The piston is releasably engaged to the floating platform, so that a disengaged position allows the traveling slip to move independent from vertical movement of the floating platform.

Beside heave compensation, another problem with snubbing pipe is buckling. There is typically an unsupported length of the pipe between the traveling slips and the standing or stationary slips of the snubbing unit. When the traveling slips push downward on the pipe, this unsupported length of pipe is in compression, and may be prone to buckling. A buckling guide can be used to try and prevent buckling. For subsea production systems, snubbing coiled tubing, instead of more conventional pipe is desirable. Coiled tubing is even more susceptible to buckling because of the material composition and relatively smaller diameter. The buckling concern is a serious obstacle for snubbing coiled tubing.

United States Patent Publication No. 20120006565, published for McKinnon et al on Jan. 12, 2012, describes a pipe guide for a snubbing unit. The pipe guide has an adjustable collar to brace the pipe between the traveling slips and the stationary slips of the snubbing unit. The pipe guide has a frame that moves in coordination with the traveling slips of the snubbing jack.

In riserless interventions, the force necessary to snub into the well is provided by the snubbing jack at the subsea location. The snubbing jack components are responsible for more providing the additional force and the reliability of holding the tubular member. In prior art systems, the stationary slips and traveling slips were coordinated with the power and force from the injector on the rig. These prior art components may require adjustments to account for the additional functionality and responsibility for safety during subsea snubbing without a riser.

It is an object of the present invention to provide a snubbing unit to prevent buckling of a tubular member when snubbing into a well without a riser.

It is another object of the present invention to provide a snubbing unit to prevent buckling of a tubular member between two sets of traveling slips and one set of stationary slips of the snubbing unit.

It is an object of the present invention to provide a snubbing unit cooperative with a pipe guide for inserting a length of the tubular member into a well without a riser.

It is an object of the present invention to provide a snubbing unit with a pipe guide for inserting coiled tubing into a subsea well without a riser.

It is another object of the present invention to provide a snubbing unit cooperative with a pipe guide for supporting a length of the tubular member between two sets of traveling slips and the one set of stationary slips of the snubbing unit.

It is an object of the present invention to provide a snubbing unit with additional traveling slips for improved safety.

It is an object of the present invention to provide a snubbing unit with additional traveling slips for a multiple stage insertion of a tubular member without a riser.

It is another object of the present invention to provide a snubbing unit with additional traveling slips and a pipe guide for a multiple stage insertion of a tubular member and consistent support of the tubular member.

These and other objects and advantages of the present invention will become apparent from a reading of the attached specification and appended claims.

BRIEF SUMMARY OF THE INVENTION

Embodiments of the snubbing unit of the present invention include a set of stationary slips in a first base plate, a first set of traveling slips in a second base plate, a second set of traveling slips in a third base plate, and a plurality of hydraulic cylinders connecting the first base plate to the second base plate and the second base plate to the third base plate. Each set of slips has an engaged position and a released position relative to the hydraulic cylinders. Actuation of the hydraulic cylinders corresponds to movement of the second base plate relative to the first base plate and movement of the third base plate to the second base plate. In some embodiments, the movement of the second base plate to the first base plate determines the movement of the third base plate to the second base plate.

In some embodiments, each hydraulic cylinder includes an inner guide tube, a piston rod, and a piston cylinder. Each inner guide tube has a distal end attached to the third base plate and a proximal end engaged to a respective piston cylinder. The inner guide tube slides in and out of the respective piston cylinder according to position of the piston rod. The inner tube guide can be stationary or moving, and the relationship of the sets of slips change according to the activity of the inner tube guide.

The present invention also includes embodiments of an assembly for inserting a tubular member. The assembly includes the snubbing unit, a tubular member inserting through the snubbing unit, and a pipe guide apparatus between the first base plate and the third base plate and through the second base plate. The tubular member also insert through the pipe guide apparatus. The engaged positions and released positions of the sets of slips now correspond to the sets of slips releasably engaging the tubular member, in addition to the position of the hydraulic cylinders. Furthermore, the top end of the pipe guide apparatus is mounted to the third base plate and a bottom end of the pipe guide apparatus is mounted to the first base plate. The support of the tubular member by the pipe guide apparatus is now coordinated with the snubbing unit, such that the protection of the tubular member is consistent through the different sequences of releasing and engaging the sets of slips in any insertion through the well. The additional safety and consistent support to prevent buckling enables the present invention to reliably insert tubular members into a well without a riser.

One embodiment of a pipe guide apparatus includes a lower slotted cylinder being comprised of a bottom base ring on a bottom base end and a plurality of finger extensions projecting upward from the bottom base ring to an extension tip end, and an upper slotted cylinder being comprised of an upper base ring on a top base end and a plurality of complementary finger extensions projecting downward from the upper base ring to a complementary extension tip end. The interaction of the finger extensions and complementary finger extensions can be coordinated with the sequences of releasing and engaging the sets of slips of the snubbing unit. There are different relationships depending upon the tubular member being stationary or being in motion.

DETAILED DESCRIPTION OF THE INVENTION

Figure 1:
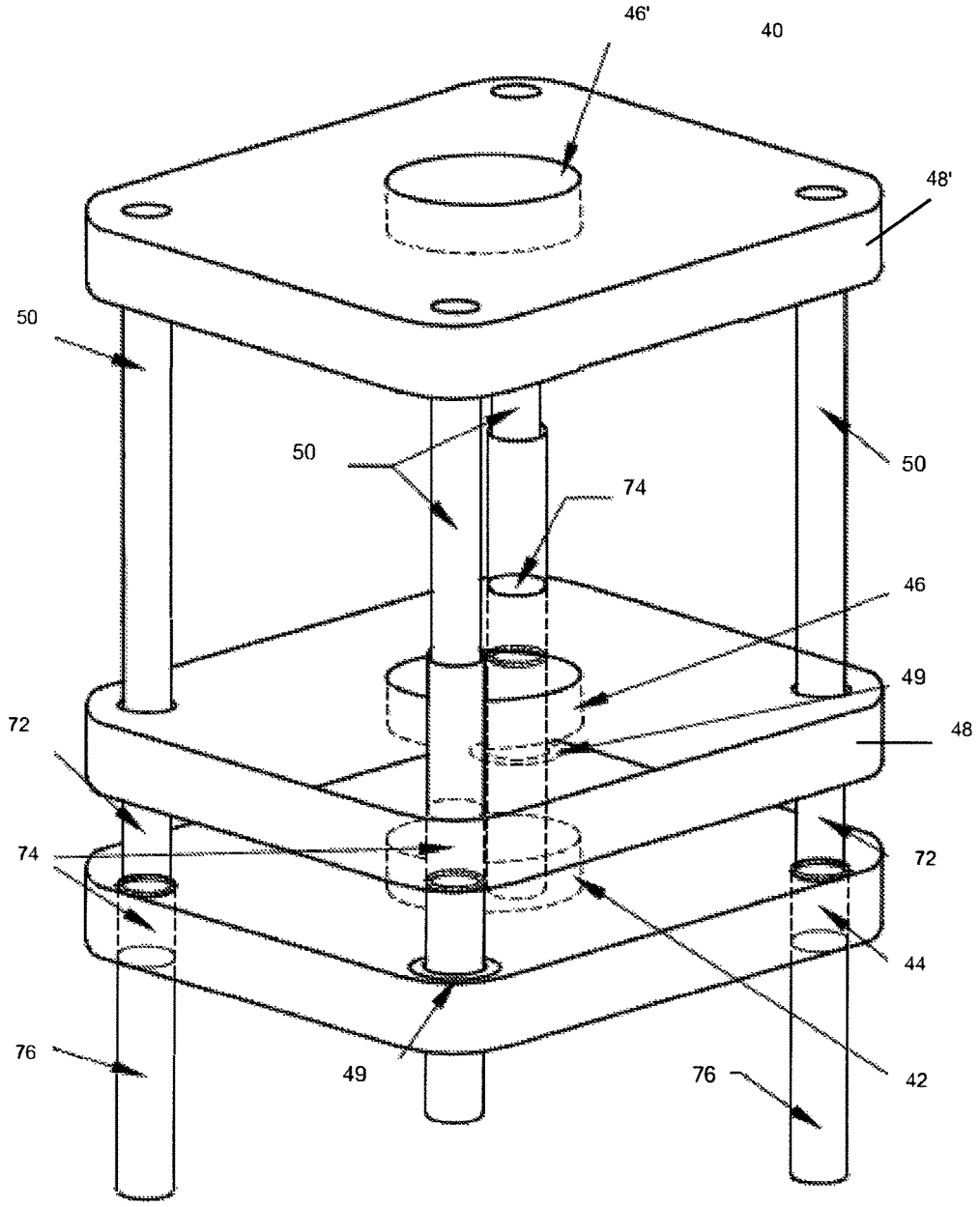
FIG. 1 is a perspective view of an embodiment of the snubbing unit of the present invention.

Referring to FIGS. 1, 2A, 2B, 2C, and 2D, an embodiment of the snubbing unit 40 can be part of an assembly for inserting a tubular member into a well without a riser. A pipe, coiled tubing, or other tubular member is pushed into a well under pressure and without a riser by the snubbing unit 40. A pipe guide apparatus prevents buckling of the pipe or tubular member, during the snubbing operation. In this embodiment, the snubbing unit 40 includes a set of stationary slips 42 in a first base plate 44, a first set of traveling slips 46 in a second base plate 48, a second set of traveling slips 46' in a third base plate 48', and a plurality of hydraulic cylinders 50 connecting the first base plate 44 to the second base plate 48 and to the third base plate 48'. Each slips 42 46, 46' have an engaged position and a released position relative to the hydraulic cylinders 50.

The additional set of traveling slips, the second set of traveling slips 46' on the third base plate 48' is a redundancy to add safety and power. Without a riser, the pressure to insert the tubular member at the well is subsea, and there is no surface level structure to power and stabilize the tubular member from above. The second set of traveling slips 46' are an additional grip on the tubular member for a back up control of the tubular member to the first set of traveling slips 46. If there is a slip in the first set of traveling slips 46, there is a second set of traveling slips 46' to maintain hold of the tubular member. The pressure to insert or retract the tubular member can also be exerted by at least one of the sets of traveling slips 46, 46' or both. When the tubular member is coiled tubing, there is a heightened need for a backup to increase safety. FIG. 1 shows guide bushings 49 at the connections between the base plates 44, 46, 46' and the hydraulic cylinders 50.

Actuation of the hydraulic cylinders 50 corresponds to movement of the second base plate 48 relative to the first base plate 44 and movement of the third base plate 48' to the second base plate 48. Although there is a redundancy of components, the second set of traveling slips 46' has different relationships to the other parts of the snubbing unit 40. Although mechanical parts may be the same, the second set of traveling slips 46' are not the same as the first set of traveling slips 46 and do not relate to the other structures the same as the first set of traveling slips 46. In embodiments of the present invention, movement of the second base plate 48 to the first base plate 44 determines movement of the third base plate 48' to the second base plate 48. When movement of the second base plate 48 to the first base plate 44 stops when the second base plate 48 is generally adjacent to the first base plate 44, the tubular member can still continue inserting, so the second set of traveling slips 46' and the third base plate 48' continue moving, as a second stroke of the insert. The second set of traveling slips 46' remain in the engaged position, while the first set of traveling slips 46 have switched to the released position. The present invention recites this interaction of two different sets of traveling slips.

Referring to FIG. 1, each hydraulic cylinder 50 can comprise an inner guide tube 72, a piston rod 74, and a piston cylinder 76. Each inner guide tube 72 has a distal end 72' attached to the third base plate 48' and a proximal end 72" engaged to a respective piston cylinder 76. The inner guide tube 72 slides in and out of a respective piston cylinder 76. The piston rod 74 sets the position of the inner guide tube 72 relative to the piston cylinder 76. Each piston rod 74 is attached to the first base plate 44, so the set of stationary slips 42 are mounted at the insertion of the inner guide tube 72 into the piston cylinder 76. As such, each piston cylinder 76 may be under the first base plate. In other embodiments the piston rod 74 can be attached to the second base plate 46, so the inner guide tube 72 inserts into the piston cylinder 76 at the second base plate 46. This other embodiment corresponds to movement of the second set of traveling slips 46' toward the first set of traveling slips 46. In multiple stages, the third base plate 48' moves to the second base plate 48 separate from the second base plate 48 moving toward the first base plate 44.

Whether the snubbing unit 40 is extended or collapsed or transitioning between extended and collapsed, the second set of traveling slips 48' have a different relationship to the other components. Being extended, collapsed, or transitioning between extended and collapsed corresponds to each inner guide tube 72 being stationary or being in motion. Furthermore, each inner guide tube 72 being stationary or being in motion can correspond to a tubular member being stationary or being in motion.

When each inner guide tube 72 is stationary relative to the first base plate 44, at least one of the set of stationary slips 42, the first set of traveling slips 46, and the second set of traveling slips 46' is in an engaged position. This configuration corresponds to a tubular member inserting through the snubbing unit 40. At least one of the slips must be gripping and holding the tubular member. One embodiment is the set of stationary slips 42 being in an engaged position with the two sets of traveling slips 46, 46' can be engaged or released. Alternatively, all of the slips 42, 46, 46' can be in a released position with the inner guide tubes 72 stationary, but this alternative configuration is not snubbing. That is, the tubular member is passing freely through the snubbing unit 40.

The present invention discloses the redundant second set of traveling slips 46' with a particular relationship to other components, during the act of snubbing, i.e. when the inner guide tube 72 is moving relative to the first base plate 44. The set of stationary slips 42 must be in a released position so that the tubular member can pass through the snubbing unit 40. In one embodiment, at least one of the first set of traveling slips 46 and the second set of traveling slips 46' is in an engaged position. In a multiple stage embodiment, when the second base plate 48 has reached the first base plate 44, the second base plate 48 can no longer move relative to the first base plate 44, even though there is more inner guide tube 72 and more tubular member to pass. Thus, each inner guide tube 72 remains in motion relative to the first base plate 44, and the set of stationary slips 42 and the first set of traveling slips 48 are in a released position. Only the second set of traveling slips 46' are in an engaged position. The second set of traveling slips 46' are not just a repeat of the first set of traveling slips 46.

FIGS. 2A, 2B, 2C, and 2D also disclose embodiments of the present invention as an assembly 1 of the snubbing unit 40 and a pipe guide apparatus 10, 110. The assembly 1 includes the snubbing unit 40, a tubular member 60 inserting through the snubbing unit 40, and the pipe guide apparatus 10, 110 with the tubular member 60 inserting through the pipe guide apparatus 10, 110 as well.

The tubular member 60 spans from the third base plate 48' to the second base plate 48 and from the second base plate 48 to first base plate 44. Each of the set of stationary slips 42, the first set of traveling slips 46, and the second set of traveling slips 46' releasably engage the tubular member 60. The engaged position and the released position of each slips 42, 46, 46' can refer to fixedly attached to the tubular member 60. These positions related to different positions of the pipe guide apparatus 10, 110 in the assembly 1 of the present invention.

Figure 2A:
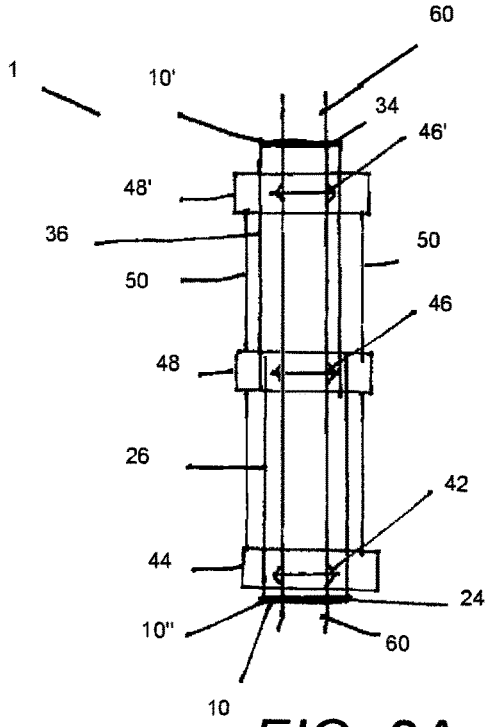
FIGS. 2A, 2B, 2C, and 2D are schematic illustrations of embodiments of the assembly for inserting a tubular member of the present invention.
Figure 2B:
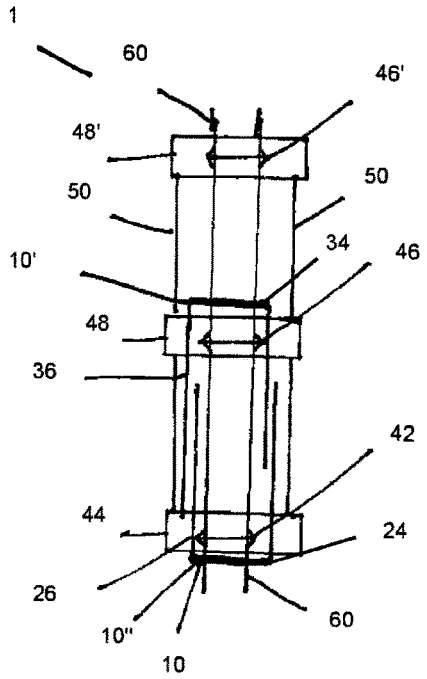
Figure 2C:
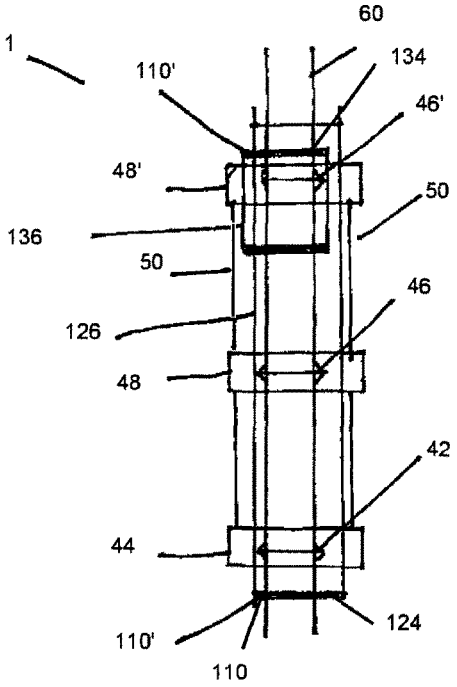

FIGS. 2A and 2C show the pipe guide apparatus 10, 110 as set between the first base plate 44 and the third base plate 48', although the pipe guide apparatus 10, 110 extends through the second base plate 48 without necessarily engaging the second base plate 48. The pipe guide apparatus 10, 110 has a top end 10', 110' mounted to the third base plate 48' and a bottom end 10", 110" mounted to the first base plate 44.

Figure 2D:
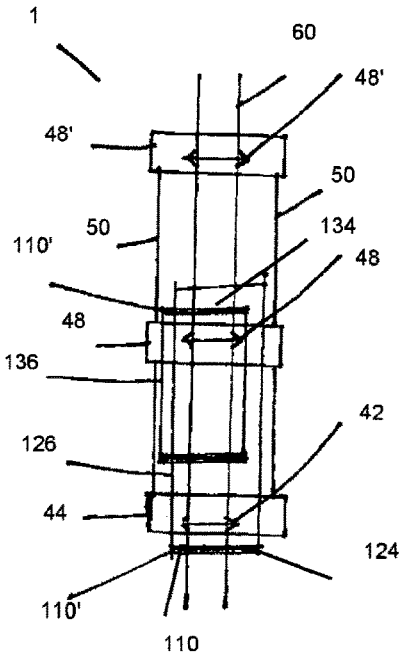

FIGS. 2B and 2D show the pipe guide apparatus 10, 110 as set between the first base plate 44 and the second base plate 48. The pipe guide apparatus 10, 110 has a top end 10', 110' mounted to the second base plate 48 and a bottom end 10", 110" mounted to the first base plate 44. In these variations, the second set of traveling slips 46' at the third base plate 48' are backup slips to activate, if the first set of traveling slips 46 fail.

Referring to FIGS. 2A, 2B, and 3-4, an embodiment of the pipe guide apparatus 10 is compatible with the snubbing unit 40. The tubular member 60 is pushed into a well under pressure by the snubbing unit 40. The pipe guide apparatus 10 prevents buckling of the tubular member 60, during the snubbing operation. The pipe guide apparatus 10 protects the tubular member along the entire length through the snubbing unit 40.

Figure 3:
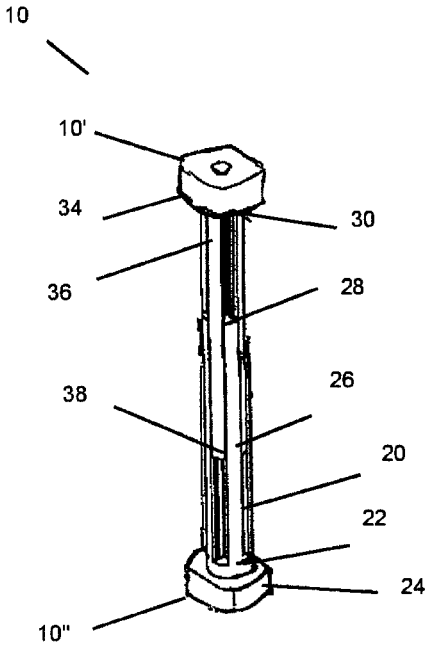
FIG. 3 is a perspective view of a first embodiment of a pipe guide apparatus of the assembly in FIG. 2.
Figure 4:
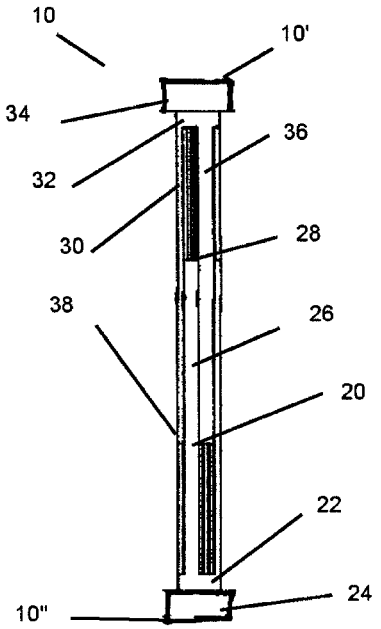
FIG. 4 is a front elevation view of the embodiment of FIG. 3.

FIGS. 3-4 show the lower slotted cylinder 20 and the upper slotted cylinder 30. The lower slotted cylinder 20 comprises a bottom base ring 22 on a bottom base end 24 at the bottom end 10" and a plurality of finger extensions 26 projecting upward from the bottom base ring 22 to an extension tip end 28. The upper slotted cylinder 30 comprises an upper base ring 32 on a top base end 34 at the top end 10' and a plurality of complementary finger extensions 36 projecting downward from the upper base ring 32 to a complementary extension tip end 38.

FIGS. 3-4 show the lower slotted cylinder 20 engaging the upper slotted cylinder 30 by sliding the finger extensions 26 between the complementary finger extensions 36. The slots between the finger extensions 26 align with the complementary finger extensions 36, and the slots between the complementary finger extensions 36 align with the finger extensions 26. When the top base end 34 moves toward the bottom base end 24, the extension tip end 28 slides past the complementary extension tip end 38. The finger extensions 26 and the complementary finger extensions 36 interlock and alternate, when they overlap as the top base end 34 moves toward the bottom base end 24. Portions of the pipe or tubular member within the pipe guide apparatus 10 is circumscribed by alternating finger extensions 26 and complementary finger extensions 36.

In an expanded configuration, the extension tip end 28 faces the complementary extension tip end 38. The bottom base end 24 is the furthest distance from the top base end 32. In a condensed configuration with the extension tip end 28 adjacent the top base end 32 and the complementary tip end 38 adjacent the bottom base end 24, the distance between the bottom base end 24 and the top base end 32 is the smallest. In the transitional configuration between the expanded configuration and the condensed configuration, the finger extensions 26 partially interlock with the complementary finger extensions 36. The actuation between the expanded configuration to the condensed configuration can correspond to one stroke of the snubbing unit 40.

Referring to FIGS. 2C, 2D, and 5-6, an embodiment of the pipe guide apparatus 110 is compatible with the snubbing unit 40. The pipe guide apparatus 110 includes the lower slotted cylinder 120 and the upper slotted cylinder 130. The lower slotted cylinder 120 comprises a bottom base ring 122 on a bottom base end 124 at the bottom end 10" and a plurality of finger extensions 126 projecting upward from the bottom base ring 122 to an extension tip end 128. The upper slotted cylinder 130 comprises an upper base ring 132 on a top base end 134 at the top end 10' and a plurality of complementary finger extensions 136 projecting downward from the upper base ring 132 to a complementary extension tip end 138.

Figure 5:
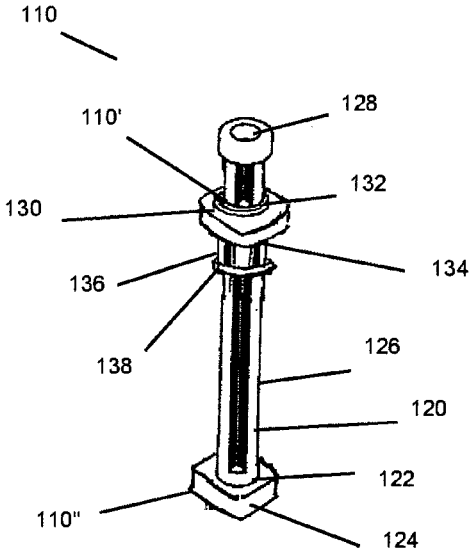
FIG. 5 is a perspective view of a second embodiment of the pipe guide apparatus of the assembly in FIG. 2.
Figure 6:
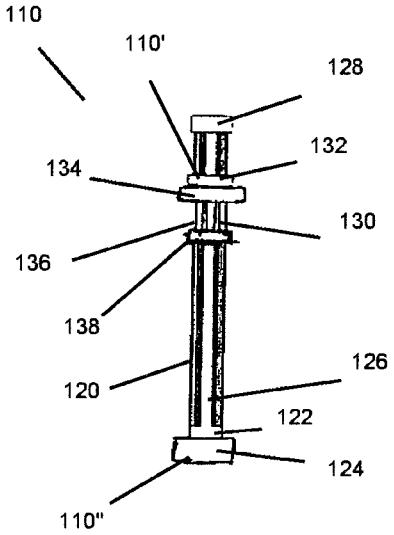
FIG. 6 is a front elevation view of the embodiment of FIG. 5.

FIGS. 5-6 show the lower slotted cylinder 120 engaging the upper slotted cylinder 130 by sliding the finger extensions 126 between the complementary finger extensions 136. The slots between the finger extensions 126 align with the complementary finger extensions 136, and the slots between the complementary finger extensions 136 align with the finger extensions 126. In this embodiment, the finger extensions 126 also pass through the upper base ring 132. The upper slotted cylinder 130 is mounted between the bottom base end 122 and the extension tip end 128 of the lower slotted cylinder 20. When the top base end 134 moves toward the bottom base end 124, the upper base end 132 and the complementary extension tip end 138 are oriented along the finger extensions 126. The finger extensions 126 and the complementary finger extensions 136 still interlock and alternate. At least a portion of the pipe or tubular member within the pipe guide apparatus 110 is circumscribed by alternating finger extensions 126 and complementary finger extensions 136.

In an expanded configuration, the extension tip end 128 remains above the upper slotted cylinder 130. The bottom base end 122 is the furthest distance from the top base end 132, when the upper slotted cylinder 130 is adjacent to the extension tip end 128. In a condensed configuration, the complementary extension tip end 138 is adjacent to the bottom base end 122, the distance between the bottom base end 122 and the top base end 132 being the smallest. In the transitional configuration between the expanded configuration and the condensed configuration, the complementary finger extensions 136 remain interlocked with the finger extensions 126. The remaining portions between the extension tip end 128 and bottom base end 122 are only supported by the finger extensions 126. The actuation between this embodiment of the expanded configuration to the condensed configuration can still correspond to one stroke of the snubbing unit.

According to FIG. 2A, the bottom base end 24 is mounted to the first base plate 44 and the top base end 34 is mounted to the third base plate 48'. Alternatively, in FIG. 2B, the bottom base end 24 is mounted to the first base plate 44 and the top base end 34 is mounted to the second base plate 48 for the second set of traveling slips 48' in a backup only relationship to the assembly 1.

According to FIG. 2C, the bottom base end 124 is mounted to the first base plate 44 and the top base end 134 is mounted to the third base plate 48'. Alternatively, in FIG. 2D, the bottom base end 124 is mounted to the first base plate 44 and the top base end 134 is mounted to the second base plate 48 for the second set of traveling slips 48' in a backup only relationship to the assembly 1. In this embodiment, the finger extensions 126 extend through the upper base ring 122.

Now for the embodiment of the assembly 1, whether the snubbing unit 40 is extended or collapsed or transitioning between extended and collapsed, the second set of traveling slips 48' have a different relationship to the components of the pipe guide apparatus 10, 110 of the assembly 1. Being extended, collapsed, or transitioning between extended and collapsed corresponds to the tubular member 60 being stationary or being in motion and to different configurations of the pipe guide apparatus 10, 110.

When the tubular member 60 is stationary relative to the first base plate 44, at least one of the set of stationary slips 42, the first set of traveling slips 46, and the second set of traveling slips 46' is in an engaged position. The pipe guide apparatus 10, 110 is in the extended position with the top base end 24, 124 at the third base plate 48' and the bottom base end 34, 134 at the first base plate 44. This configuration corresponds to a tubular member 60 inserting through the snubbing unit 40 and being held by the snubbing unit 40 with protection of the pipe guide apparatus 10, 110 from the third base plate 48' to the first base plate 44. At least one of the slips must be gripping and holding the tubular member. One embodiment is the set of stationary slips 42 being in an engaged position with the two sets of traveling slips 46, 46' being either engaged or released.

Alternatively, all of the slips 42, 46, 46' can be in a released position with the tubular member 60 stationary, but this alternative configuration is not snubbing. That is, the tubular member 60 would be passing freely through the snubbing unit 40 or set still in the assembly 1. However, there is no utility for this alternative configuration in a subsea location.

The present invention discloses the assembly 1 with the redundant second set of traveling slips 46' with a particular relationship to other components, during the act of snubbing, i.e. when the tubular member 60 is moving relative to the first base plate 44. The set of stationary slips 42 must be in a released position so that the tubular member 60 can pass through the snubbing unit 40. In one embodiment, at least one of the first set of traveling slips 46 and the second set of traveling slips 46' is in an engaged position. The pipe guide apparatus 10, 110 is moving from the extended position with the top base end 24, 124 at the third base plate 48' to the condensed position with the bottom base end 34 134 at the first base plate 44.

There is also an embodiment with the pipe guide apparatus 10, 110 is moving from the extended position with the top base end 24, 124 at the second base plate 48 to the condensed position with the bottom base end 34, 134 at the first base plate 44. The second set of traveling slips 46' is in a backup only relationship to the assembly 1. The tubular member 60 is in motion relative to the first base plate 44, the set of stationary slips 42 being in a released position, the first set of traveling slips 46 being in an engaged position, and the second set of traveling slips 46' being in an engaged position.

In another multiple stage embodiment, when the second base plate 48 has reached the first base plate 44, the second base plate 48 can no longer move relative to the first base plate 44, even though there is more tubular member 60 to pass. Thus, the tubular member 60 remains in motion relative to the first base plate 44, and the set of stationary slips 42 and the first set of traveling slips 48 are in a released position. The pipe guide apparatus 10, 110 is still moving from the extended position with the top base end 24, 124 at the third base plate 48' to the condensed position with the bottom base end 34, 134 at the first base plate 44. Again, only the second set of traveling slips 46' are in an engaged position and the pipe guide apparatus 10, 110 remains engaged to the third base plate 48'. Again, the second set of traveling slips 46' are not just a repeat of the first set of traveling slips 46.

Consistent with FIG. 1, the assembly 1 of FIGS. 2A, 2B, 2C, and 2D can also include each hydraulic cylinder 50 comprising an inner guide tube 72, a piston rod 74, and a piston cylinder 76. Each piston rod 74 attached to the first base plate 44 sets the relative positions of the pipe guide apparatus 10, 110 relative to particular components of the hydraulic cylinder 50 of FIG. 1.

The present invention provides a snubbing unit to prevent buckling of a tubular member when snubbing into a well without a riser. In a subsea well without a riser, the pressure to insert the tubular member at the well is far from the surface, and there is no surface level structure to power and stabilize the tubular member from above. The snubbing unit of the present invention includes two sets of traveling slips and one set of stationary slips of the snubbing unit. The additional set of traveling slips is a redundancy to add safety and power. As a backup, there is another set of slips to grip the tubular member, in case of failure of the first set of traveling slips. At the subsea location and with the force being supplied subsea, there is a need to have a backup at the same subsea location. The pressure and force to insert or retract the tubular member can also be exerted by at least one of the sets of traveling slips or both. When the tubular member is coiled tubing, there is a heightened need for a backup to increase safety and reliability.

Embodiments of the present invention provide an assembly with a snubbing unit cooperative with a pipe guide. With the force and pressure at the subsea location, the pipe guide can provide support to prevent buckling during the snubbing. The additional safety of the snubbing unit remains compatible with a pipe guide. The pipe guide can be set relative to the two sets of traveling slips and the one set of stationary slips of the snubbing unit for supporting the entire length of the tubular member, even in a single stage or multiple stage insertion. Even as the first set of traveling slips and the second set of traveling slips change relative engaged and released positions, the pipe guide maintains protection of the tubular member without a disruption or transition corresponding to the changes in the sets of traveling slips.

In multiple stage embodiments, the first set of traveling slips are engaged to the tubular member for insertion, and then the first set of traveling slips are released from the tubular member as insertion continues. In the present invention, the assembly maintains protection from buckling of the tubular member during both stages. Thus, the additional traveling slips can perform as more than a backup to increase safety. The pipe guide provides consistent and reliable support of tubular member through the actuation of the snubbing unit with more than one set of traveling slips.

The foregoing disclosure and description of the invention is illustrative and explanatory thereof. Various changes in the details of the described method can be made without departing from the true spirit of the invention.

We claim:

1. A snubbing unit, comprising:

a. a set of stationary slips disposed into a first base plate;

b. a first set of traveling slips disposed into a second base plate, the second base plate movable relative to the first base plate;

c. a second set of traveling slips disposed into a third base plate, the second base plate movable relative to the third base plate such that movement of the second base plate relative to the first base plate determines movement of the third base plate relative to the second base plate; and d. a plurality of hydraulic cylinders connecting said first base plate to said second base plate and said second base plate to said third base plate, each set of slips comprising an engaged position and a released position relative to the hydraulic cylinders, each hydraulic cylinder of the plurality of hydraulic cylinders comprising an inner guide tube, a piston rod, and a piston cylinder, each hydraulic cylinder of the plurality of hydraulic cylinders being operable when actuated to move the second base plate relative to the first base plate and move the third base plate relative to the second base plate.

2. The snubbing unit, according to claim 1, wherein the inner guide tube is slidable into a respective piston cylinder according to position of said piston rod, each piston rod being attached to said first base plate, each respective piston cylinder being positioned beneath said first base plate.

3. The snubbing unit, according to claim 1, each inner guide tube of each hydraulic cylinder having a distal end attached to said third base plate and a proximal end engaged to a respective piston cylinder.

4. The snubbing unit, according to claim 1, wherein each inner guide tube is stationary relative to said first base plate, wherein at least one of said set of stationary slips, said first set of traveling slips, and said second set of traveling slips is in an engaged position.

5. The snubbing unit, according to claim 1, wherein each inner guide tube is stationary relative to said first base plate, said set of stationary slips being in an engaged position.

6. The snubbing unit, according to claim 1, wherein each inner guide tube is in motion relative to said first base plate, said set of stationary slips being in a released position, and wherein at least one of said first set of traveling slips and said second set of traveling slips is in an engaged position.

7. The snubbing unit, according to claim 1, wherein said second base plate is adjacent to said first base plate, and wherein each inner guide tube is in motion relative to said first base plate, said set of stationary slips being in a released position, said first set of traveling slips being in a released position, said second set of traveling slips being in an engaged position.

8. An assembly for inserting a tubular member, comprising:

a. a snubbing unit, comprising a set of stationary slips disposed into a first base plate, a first set of traveling slips disposed into a second base plate, a second set of traveling slips disposed into a third base plate, and a plurality of hydraulic cylinders connecting said first base plate to said second base plate and said second base plate to said third base plate, each hydraulic cylinder of the plurality of hydraulic cylinders comprising an inner guide tube, a piston rod, and a piston cylinder, each of said hydraulic cylinders operative when actuated to move said second base plate relative to said first base plate and move said third base plate relative to said second base plate, wherein said movement of said second base plate to said first base plate determines said movement of said third base plate to said second base plate;

b. a tubular member inserting through said snubbing unit from said third base plate to said second base plate and said second base plate to first base plate, said tubular member being releasably engaged to said set of stationary slips, said tubular member being releasably engaged to said first set of traveling slips, said tubular member being releasably engaged to said second set of traveling slips; and c. a pipe guide apparatus being set between said first base plate and said third base plate and through said second base plate and having a top end mounted to said third base plate and a bottom end mounted to said first base plate, said tubular member inserting through said pipe guide apparatus, d. wherein each slips have an engaged position and a released position relative to said tubular member and said pipe guide apparatus.

9. The assembly, according to claim 8, wherein said pipe guide apparatus comprises:

a. a lower slotted cylinder comprising a bottom base ring on a bottom base end at said bottom end and a plurality of finger extensions projecting upward from said bottom base ring to an extension tip end; and b. an upper slotted cylinder comprising an upper base ring on a top base end at said top end and a plurality of complementary finger extensions projecting downward from said upper base ring to a complementary extension tip end, c. wherein said lower slotted cylinder engages said upper slotted cylinder, said finger extensions sliding between said complementary finger extensions when said top base end moves toward said bottom base end, and d. wherein the finger extensions maintain alignment of said tubular member, the complementary finger extensions maintaining alignment of said tubular member, both the finger extensions and the complementary finger extensions together maintaining alignment of said tubular member.

10. The assembly, according to claim 9, wherein said bottom base ring is mounted to said first base plate, and wherein said upper base ring is mounted to said third base plate.

11. The assembly, according to claim 9, wherein said bottom base ring is mounted to said first base plate, and wherein said upper base ring is mounted to said second base plate.

12. The assembly, according to claim 9, wherein said finger extensions extend through said upper base ring, wherein said bottom base ring is mounted to said first base plate, and wherein said upper base ring is mounted to said third base plate.

13. The assembly, according to claim 9, wherein said finger extensions extend through said upper base ring, wherein said bottom base ring is mounted to said first base plate, and wherein said upper base ring is mounted to said second base plate.

14. The assembly, according to claim 8, wherein said tubular member is stationary relative to said first base plate, said set of stationary slips being in an engaged position, and wherein at least one of said first set of traveling slips and said second set of traveling slips is in an engaged position.

15. The assembly, according to claim 8, wherein said tubular member is stationary relative to said first base plate, said set of stationary slips being in an engaged position, said first set of traveling slips being in a released position, and said second set of traveling slips being in a released position.

16. The assembly, according to claim 8, wherein said tubular member is in motion relative to said first base plate, said set of stationary slips being in a released position, said first set of traveling slips being in an engaged position, said second set of traveling slips being in an engaged position.

17. The assembly, according to claim 8, wherein said tubular member is in motion relative to said first base plate, said set of stationary slips being in a released position, and wherein at least one of said first set of traveling slips and said second set of traveling slips is in an engaged position.

18. The assembly, according to claim 9, wherein said upper base ring is mounted to said third base plate, wherein said second base plate is adjacent to said first base plate, and wherein said tubular member is in motion relative to said first base plate, said set of stationary slips being in a released position, said first set of traveling slips being in a released position, said second set of traveling slips being in an engaged position.

19. The assembly, according to claim 8, wherein each hydraulic cylinder comprises an inner guide tube, a piston rod, and a piston cylinder, each inner guide tube being slidable into a respective piston cylinder according to position of said piston rod, each piston rod being attached to said first base plate, each respective piston cylinder being positioned beneath said first base plate.

20. The assembly, according to claim 8, each inner guide tube having a distal end attached to said third base plate and a proximal end engaged to a respective piston cylinder.

* * * * *